United States Patent [19]

McCaleb

[11] 4,032,777

[45] June 28, 1977

[54] PHOTOMERIC MONITORING DEVICE

[76] Inventor: Robert Earl McCaleb, 5704 NE. 36th Ave., Portland, Oreg. 97211

[22] Filed: Mar. 29, 1976

[21] Appl. No.: 671,057

[52] U.S. Cl. ..... 250/214 B; 250/205; 250/214 RC; 250/221

[51] Int. Cl.[2] ..... H01J 39/12

[58] Field of Search ..... 250/214 R, 214 A, 214 B, 250/214 RC, 205, 221, 564, 565

[56] References Cited

UNITED STATES PATENTS

| | | | |
|---|---|---|---|
| 3,582,661 | 6/1971 | Emmasingel | 250/205 |
| 3,775,617 | 11/1973 | Dubauskas | 250/210 |
| 3,931,513 | 1/1976 | Germain | 250/205 |

*Primary Examiner*—David C. Nelms
*Attorney, Agent, or Firm*—George T. Noe

[57] ABSTRACT

A photometric monitoring device for detection and surveillance of objects entering and leaving a light field is provided wherein a monitored light source is compared with a reference light source in such a manner that abrupt or rapid changes in monitored light are detected and gradual changes are ignored. A first photo cell for monitoring a light source is coupled to the input of an operational amplifier having a feedback loop which includes a reference light source coupled to a second photocell. An RC network delays the reaction of the operational amplifier in balancing the voltage across both of said first and second photocells when abrupt changes occur, allowing a signal to be developed. Additional circuitry includes a comparator responsive to such developed signals which exceed predetermined limits, producing an output signal for use by a utilization device, such as a camera, recording device, alarm system, or the like.

11 Claims, 5 Drawing Figures

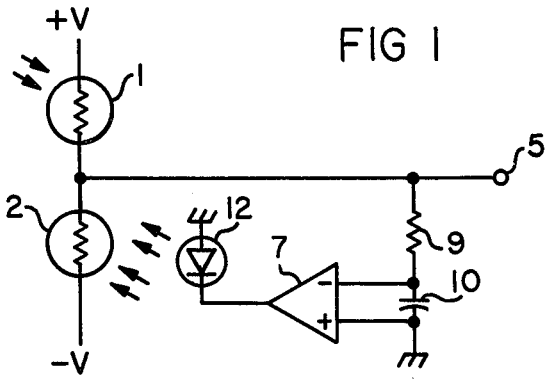
FIG 1
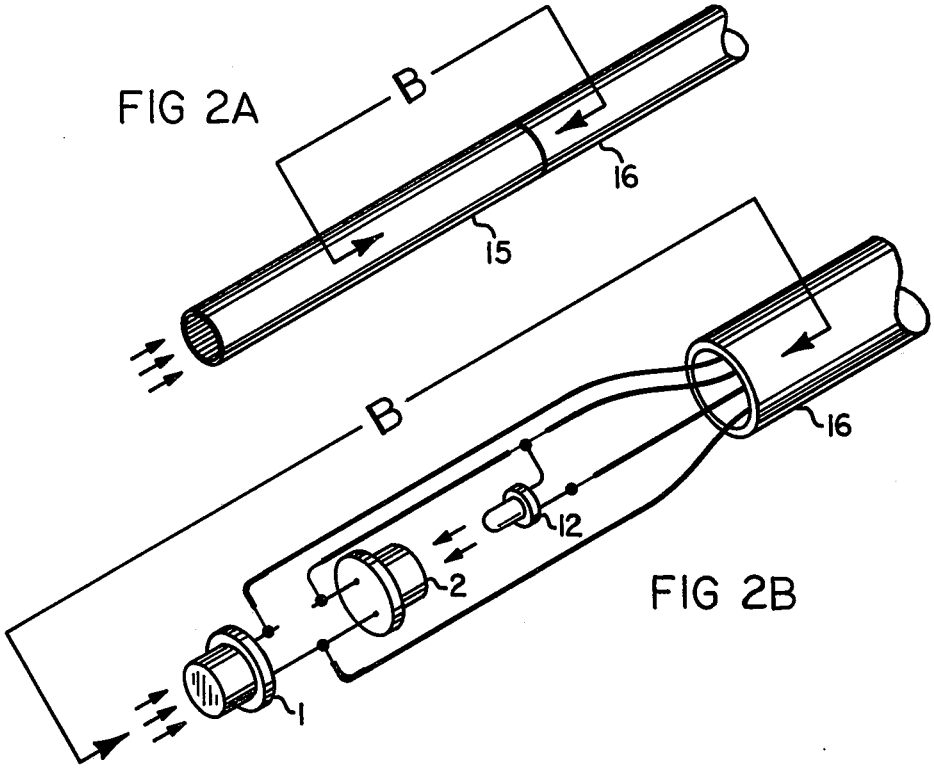
FIG 2A
FIG 2B
FIG 3
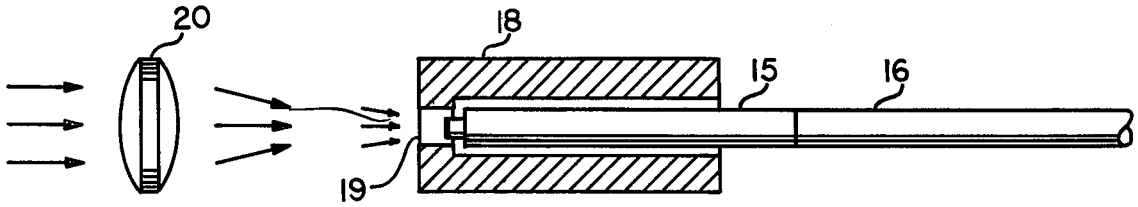

PHOTOMERIC MONITORING DEVICE

BACKGROUND OF THE INVENTION

This invention relates to photometric monitoring devices in general, and more particularly to detection and surveillance devices for objects, for example, intruders, entering or leaving a monitored area.

Previous photometric devices may be divided into two classes, those in which a constant light source is spaced from a photocell so that an object passing therebetween breaks a light beam, and those in which a monitored light source is converted to an analog signal. The constant light beam devices have serious limitations imposed thereon inasmuch as they must be fairly permanent installations and may monitor extremely small areas, such as window and door openings of building. Analog photometers suffer the disadvantage of being unable to respond adequately to varying ambient light conditions and light changes which take place some distance from the device. Furthermore, since they must be set to trigger at a predetermined level, such devices are unreliable and may trigger on unwanted light changes while failing to respond to desired light changes under certain conditions.

SUMMARY OF THE INVENTION

According to the present invention, a photometric monitoring device is capable of adapting to varying ambient light conditions while responding to abrupt changes. A first photocell for monitoring a light source, which may suitably be incident or reflected waves of natural or artificial light over the spectrum from ultraviolet to infrared, is coupled to one input of an operational amplifier. A feedback loop is provided for such operational amplifier including reference light source, such as a light-emitting diode, and a second photocell coupled thereto. Changes in the conducting properties of the first photocell due to changes in the monitored light source cause a corresponding change in the amount of light produced by the reference light source through operational amplifier action, and subsequently cause a change in the conducting properties of the second photocell to match those of the first photocell. An RC network in the input circuit delays the balancing action of the two photocells so that a signal is developed for abrupt or rapid changes in the monitored light source. The sensitivity of the circuit may be adjusted so that a signal is developed for very small light changes.

In one embodiment of the present invention, the developed signal is applied via an amplifier to a comparator to produce a trigger signal in response thereto. The comparator includes "trigger window" input network having predetermined hysteresis limits to aid in rejecting low-level signals while providing a positive response to signals representing abrupt or rapid light changes. Furthermore, this scheme lends the possibility of triggering on the second abrupt or rapid light change represented by the termination of an object passing through the light source. The object may be lighter or darker than the light source, or may be a source of brighter light.

The trigger pulse generated by the comparator circuit may be utilized to initiate the action of a camera, recording device, counter, alarm system, or other indicating device. A timing circuit may be included to operate such a utilization device for any predetrmined time interval, being particularly applicable to a movie camera.

The photocells may be mounted together in a probe remote from the processing circuits to permit mountng in any surveillance environment while minimizing changes due to temperature. An optical lens system may be provided in front of the monitoring photocell to provide a photometric system capable of monitoring light changes at any distance. Further, as can be seen, such a monitoring device may be mounted on or inside a camera, and may be utilized to monitor light through the camera lens system, such as in a single lens reflex camera having a through-the-lens viewing field. The addition of zoom or telephoto lens increases the versatility of the photometric monitoring system because the light changes detected thereby are those "seen" by the camera.

It is therefore one object of the present invention to provide a novel photometric monitoring system.

It is another object of the present invention to detect abrupt or rapid changes in light while rejecting gradual changes.

It is a further object of the present invention to provide a photometric monitoring system which is sensitive in any ambient lighting condition.

It is yet another object of the present invention to provide a photometric monitoring device which may be coupled to an optical lens system.

It is yet a further object of the present invention to provide a photometric monitoring system having a photocell which may be located remote from associated processing circuitry.

It is still another object of the present invention to provide a portable, lightweight photometric monitoring system applicable to any surveillance situation.

Other objects, advantages, and attainments of the present invention will be readily apparent to one having ordinary skill in the art upon a reading of the following description in connection with the accompanying drawings.

BRIEF DESCRIPTION OF THE DRAWINGS

FIG. 1 is a schematic or a photometric monitoring circuit in accordance with the present invention;

FIG. 2A shows a light probe or utilization with a photometric monitoring device;

FIG. 2B shows the arrangement of photocells and a reference light source contained within the probe of FIG. 2A;

FIG. 3 shows a cross section of a light probe for utilization with an optical lens system.

DETAILED DESCRIPTION OF THE INVENTION

Figure 4:
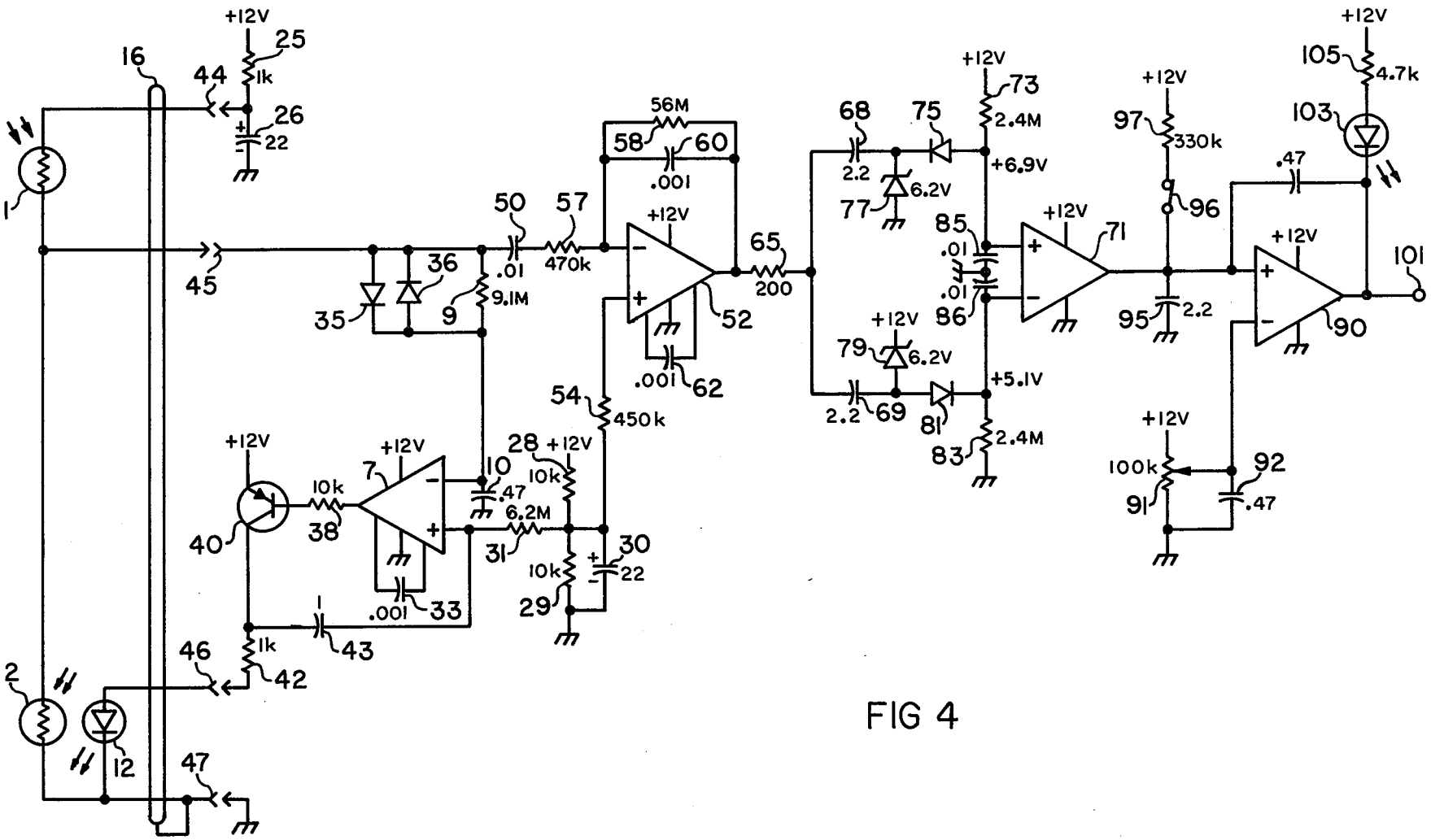
FIG. 4 shows a detailed schematic of one embodiment of a photometric monitoring system in accordance with the present invention.

Referring now to FIG. 1, a photometric monitoring device in accordance with the present invention is shown. A pair of photocells 1 and 2 of preferably the same type are serially connected between suitable sources of positive and negative voltage + and − V of preferably equal value so that when the conducting properties of both photocells are the same, the voltage therebetween, and hence at an output terminal 5, is zero volts with respect to ground reference. The photocells as shown are photoconductors, such as, for example, those commercially available by Clairex Corporation, whose conduction is proportional to the light rays impinging thereon. Other transducers such as photovoltaic devices or photo resistors may also be employed as long as appropriate supply voltage magnitudes and polarities are observed.

An operational amplifier 7, such as a commercially available 741 or LM 308 type having a pair of input terminals designated −input and +input for the inverting and non-inverting inputs respectively and an output terminal, is shown having its −input coupled with the junction of photocells 1 and 2 through a resistor 9, which is part of an RC network comprising resistor 9 and a capacitor 10 connected between the aforementioned −input and ground. The +input of operational amplifier is connected to ground. The output of operational amplifier 7, which is typically taken between a pair of internal transistors serially connected between suitable sources of positive and negative voltage, is connected through a reference light source 12 to ground. The light source 12 may suitably be a commercially available light-emitting diode, such as, for example, type MA 2404R. The light source, or light-emitting diode 12 is coupled to the photocell 2 in a shielded manner so that all of the light generated by thereby impinges on the photocell 2, and photocell 2 is suitably shielded so that all of the light impinging thereon is that generated by light-emitting diode 12.

The circuit operates as follows. Photocell 1 is utilized to monitor an external light source, and may be either artificial light such as that generated by a lighting system in a building or natural light produced by the sun. When photocell 1 receives light from the monitored light source, it conducts and produces a positive voltage proportional thereto at output terminal 5. Operational amplifier 7 senses the positive voltage is its −input, and produces a negative voltage at its output to turn on light-emitting diode 12, which in turn couples the light produced thereby to photocell 2. Through operational amplifier action, the conduction of photocell 2 matches the conduction of photocell 1 and pulls the voltage at terminal 5 back down to zero volts.

The RC network comprising resistor 9 and capacitor 10 delays the balancing action of operational amplifier 7 so that abrupt or rapid changes in light monitored by photocell 1 result in a signal at output terminal 5. Gradual changes in the monitored light source are followed by the operational amplifier balancing action so that changes in the conductive properties of photocell 1 are matched by photocell 2 and the output at terminal 5 remains at zero volts.

Abrupt changes in the monitored light source may be caused by a person or other object passing between such light source and the photocell 1, while gradual changes in such source may be caused by brightening or dimming of the light-source, such as, for example, the normal activity of the sun rising or setting or being temporarily blocked by a cloud. The values of R and C suitably may be chosen to provide the desired reaction.

Thus it may appreciated that such a photometric monitoring system may be employed in intruder surveillance applications, object-counting applications, or other applications where a rapid change in monitored light may develop a signal.

The circuitry may be contained in any suitable module, such as on a chassis or circuit board, while the photocell 1 may suitably be contained in a probe connected to the circuit by a cable and therefore be located at a site remote from the circuitry. One example of such a probe is shown in FIG. 2A.

The probe shown in FIG. 2A may simply comprise a tube 15, which may be constructed of metal, plastic, or other suitable material, into one end of which light rays may enter to impinge on the photocell contained therein. A cable 16 includes wires to connect the photocell with the associated circuit. Such a tube 15 has the advantage of being able to pinpoint a light source for monitoring applications where a high degree of sensitivity and selectivity is required. The tube should preferably be black in color to absorb unwanted surrounding light, and can be of any chosen diameter and length. However, since selectivity is a function of diameter and length, a small diameter, for example, no larger than the diameter of the photocell, should be chosen.

FIG. 2B shows a preferable arrangement of components inside the tube 15 including photocell 1, photocell 2, light-emitting diode 12, and the associated connecting wires. A sleeve (not shown) may be provided to ensure that all of the light from the reference source effected by light-emitting diode 12 is coupled directly to photocell 2 while other light is blocked out. This arrangement of including both photocells in the probe minimizes changes in the conduction properties of such photocells due to temperature variations, since both would be subject to substantially the same temperature. Photocell 1 is directed toward the light receiving opening in the end of tube 15 to be subjected thereto.

FIG. 3 is a cross-sectional drawing of a light probe for use in an optical lens system. In this probe, photocell 1 is mounted at the open end of a tube 15 while photocell 2 and light-emitting diode 12 are contained inside the tube in a manner similar to that shown in FIG. 2B. The probe is mounted in a housing 18 having a light-receiving aperture 19 spaced from a lens 20 by a distance determined by the focal length of the lens. The lens 20 may suitably be the lens system of a camera, while the light probe itself may suitably be mounted within the camera. This is a particularly useful application in cameras having through-the-lens viewing systems since the photocell 1 receives the same light as the camera, and additionally, the signal developed by the detection of a rapid lighting change may be utilized to activate the camera for taking pictures. Furthermore, if a zoom or telephoto lens system is utilized, the apparent monitoring distance of the photometric monitoring system may be increased.

FIG. 4 shows a detailed schematic of one embodiment of the present invention which has been developed for a commercial photometric monitoring system. The photocells 1 and 2 are shown serially connected between a source of +12 volts and ground. Resistor 25 and capacitor 26 provide proper decoupling of the supply voltage to prevent voltage fluctuations from affecting the photocell circuit. As can be seen, reference numerals utilized for the foregoing descriptions are utilized throughout the detailed description to provide consistency and reduce confusion.

The voltage signal developed at the junction of photocells 1 and 2, which are again photoconductive devices in this embodiment, is applied through resistor 9 to the −input of operation amplifier 7. Capacitor 10 is connected between the −input and ground as discussed previously. The reference voltage for the +input of operational amplifier 7 is established at +6 volts by a voltage divider comprising a pair of equal-valued resistors 28 and 29 which are serially connected between +12 volts and ground. A capacitor 30 is utilized to stabilize the +6 volts reference, which is applied via a resistor 31 to the +input of operational amplifier 7. A capacitor 33 is connected to available terminals of operational amplifier 7, which in this case in an LM 308 type, to act with capacitor 10 and resistor 9 in establishing the signal reaction time of the operational amplifier. A pair of diodes 35 and 36 are connected across resistor 9 to limit the input signal swing to ± 700 millivolts and thereby provide fast recovery. These diodes also aid in speeding up the settling time of the system when it is first turned on.

The output of operational amplifier 7 is connected through a base-current limiting resistor 38 to the base of a current-pass transistor 40. The emitter of transistor 40 is connected to +12 volts, while the collector thereof is connected through the reference light souce circuit comprising resistor 42 and light-emitting diode 12 to ground. A capacitor 43 is connected between the collector of transistor 40 and the +input of operational amplifier 7 to provide a secondary feedback loop to slow the reaction of the voltage swing at the collector of transistor 40, thereby suppressing oscillation tendencies.

The action of this portion of the circuit is substantially the same as that described for FIG. 1. That is, a change in the conductive properties of photocell 1 is matched by a substantially equal change in the conductive properties of photocell 2 by the balancing action of operational amplifier 7. The balancing action occurs after a short time delay if the monitored light impinging on photocell 1 changes rapidly, while following the change if it is gradual.

The photocells 1 and 2 and light-emitting diode 12 may suitably be mounted in a light probe such as described in connection with FIGS. 2 and 3, in which case a shielded cable 16 and connecting plugs 44–47 shown are utilized.

The signal developed at the junction of photocells 1 and 2 is AC coupled via a capacitor 50 to a signal amplifier comprising operational amplifier 52, which may suitably be another LM 308 type, and its associated circuitry. The +input of operational amplifier 52 is connected to the +6 volts reference established by resistors 28 and 29 through a resistor 54, whose value is selected to provide an input impedance at the +input similar to that the −input of operational amplifier 52. In the conventional inverting operational amplifier manner, input resistor 57 and feedback resistor 58 set the gain of the amplifier. For the circuit values shown in FIG. 4, the gain is about 120, which, as an example, effectively amplifiers a 15-millivolt input swing to a 1.8-volt output swing. Capacitors 60 and 62 slow the reaction time of the amplified output signal.

The amplified signal from amplifier 52 is applied via a current-limiting resistor 65 and AC coupling capacitors 68 and 69 to a voltage comparator circuit comprising comparator 71, which may suitably be an LM 311 type, and its associated circuit. This circuit responds when the signal reaches a predetermined threshold.

A "triggering window" of 1.8 volts between the + and −inputs of comparator 71 in this embodiment is established by the threshold setting networks comprising a resistor 73, diode 75, and Zener diode 77, connected between +12 volts and ground at the + input, and Zener diode 79, diode 81, and resistor 83 connected between +12 volts and ground at the −input. A negative-going 1.8-volt signal coupled via capacitor 68 will move the +input down to match the voltage at −input, causing comparator 71 to switch and generate a negative-going pulse at the output thereof. In a like manner, a positive-going 1.8-volt signal coupled via capacitor 69 will move the −input up to match the voltage at the +input, causing comparator 71 to switch, generating a negative pulse at the output thereof.

A pair of capacitors 85 and 86 are connected respectively between the + and −inputs of comparator 71 to increase the versatility of the photometric monitoring system, permitting use in applications where the sensitivity of photocell 1 is somewhat reduced, resulting in a situation where the output swing of amplifier 52 in both positive and negative directions is less than the desired 1.8 volts. For example, suppose an object moves between the monitored light source and photocell 1 and the output of amplifier 52 is caused to move negative only 1 volt. In this case, capacitor 85 is discharged only 1 volt, moving the +input negatively toward the voltage at the −input, but still requiring another 0.8 volts to reach the voltage at −input to cause the comparator to switch. If the object moves from the path between the monitored light source and photocell 1 before capacitor 85 can charge back to its quiescent point, a positive-going 1 volt swing is produced by amplifier 52, pulling the −input of comparator up 1 volt and discharging capacitor 86 by 1 volt, and in doing so, reaching the voltage held at the +input by capacitor 85, causing the comparator to switch and generating a negative pulse at the output thereof. Thus both a positive-going change and a negative-going change from photocell 1 are required within a predetermined time interval to result in a signal from comparator 71.

The negative-going pulse from comparator 71 may be utilized to operate an indicating device, or may be applied to a timing circuit to produce an operating signal of predetermined time length. One example of a timing circuit is shown in FIG. 4 and comprises comparator 90 and its associated circuitry.

The −input of comparator 90, which may suitably be another LM 311 type, is connected to a variable reference voltage produced by potentiometer 91 connected between +12 volts and ground. A capacitor 92 is provided to ensure a stable reference voltage.

The nagative-going pulse from comparator 71 is applied to the +input of comparator 90, causing comparator 90 to switch and produce a negative going step at the output thereof. Simultaneously, a timing capacitor 95 is discharged and as soon as the output of comparator 71 switches back to its reset condition, begins to charge, moving the voltage at the +input of comparator 90 in a positive direction. With a timing switch 96 open, capacitor 95 charges at a rate determined by the capacitor value and the internal leakage of comparators 71 and 90. With switch 96 closed, the charging rate of capacitor 95 is predominately determined by the values of capacitor 95 and resistor 97. Resistor 97 may be replaced by a plurality of resistors of different values to produce a plurality of different charging rates.

When the capacitor 95 charges to a level matching that set by resistor 91, comparator 90 resets generating a positive-going step at the output thereof and terminating the timing interval. A capacitor 100 is connected between the output and +input of comparator 90 to smooth the leading and trailing edges of the negative voltage timing pulse and suppress oscillation. The timing pulse is made available at output terminal 101 for operation of a camera, recording device, counter, alarm system, or the like. A visual indication of the output pulse is provided by a light-emitting diode 103, which is connected through a resistor 105 to +12 volts.

It can be seen that the sensitivity of the photometric monitoring system described hereinabove can be changed by adjusting the power supply voltage. For example, increasing the supply voltage across the photodiodes results in increased sensitivity because the signal produced by light impinging on the photocells is the same percentage of the circuit voltage and thereby is proportionately larger. Also, the sensitivity is effectively increased at the threshold comparator 71 because an increase in supply voltage increase the D.C. level at the −input thereof, moving the thresholds close together or even surpassing one another and thereby narrowing the triggering window. On the other hand, decreasing the supply voltage decreases the sensitivity because the signal voltage produced is smaller and the triggering window is wider. Both the photocell supply voltage and threshold comparator supply voltage may be adjusted simultaneously or independently of each other to establish the desired sensitivity.

In summary, a photometric monitoring system has been shown and described which provides an output responsive to rapid changes in a monitored light source while gradual changes are ignored. It will be obvious to those having ordinary skill in the art that many changes and modifications may be may in the details of the above described embodiments of the present invention. For example, different types of active devices such as transistors can be employed. Power supply voltages and component values may readily be changed to other suitable values without changing the basic operating principles of the system hereinabove described. Therefore, the scope of the present invention should only be determined by the following claims.

I claim:

1. A photometric monitoring sytem, comprising:

first transducer means for receiving light from a monitored light source and generating an electrical signal in response to a change thereof;

amplifier means responsive to said electrical signal for controlling the intensity of a reference light source;

second transducer means coupled to said first transducer means for receiving light from said reference light source and cancelling at least a portion of said electrical signal in response thereto; and utilization means responsive to said electrical signal for providing an indication of said change of monitored light.

2. A photometric monitoring system in accordance with claim 1 wherein said first transducer means and said second transducer means comprise first and second photocells having the same characteristics connected in series between a reference voltage and a supply voltage, said electrical signal being developed at the junction thereof, and said reference light source comprises a light-emitting diode, wherein light produced by said light-emitting diode is coupled to said second photocell.

3. A photometric monitoring system in accordance with claim 2 wherein said first and second photocells and said light-emitting diode are mounted together as a sub-assembly remote from said amplifier means and connected thereto by cable means, said light-emitting diode positioned adjacent said second photocell and enclosed by a shield to provide a light coupling therebetween.

4. A photometric monitoring system in accordance with claim 3 furthering including a substantially tubular member having a predetermined diameter and length and having an opening at one thereof for receiving light from said monitored light source, said first photocell being positioned therein a predetermined distance from said light receiving end.

5. A photometric monitoring system in accordance with claim 3 further including optical lens means interposed between said monitored light and said first photocell, said first photocell being positioned from said lens means a distance determined by the focal length of said lens means.

6. A photometric monitoring system in accordance with claim 1 wherein said amplifier means comprises an operational amplifier having a feedback loop including said referennce light source and said second transducer means.

7. A photometric monitoring system in accordance with claim 1 wherein each amplifier means includes a time-delay network to delay the response of said amplifier to electrical signals having a rate of change in excess of a predetermined value so that said electrical signal is developed responsive to rapid changes of light in said monitored light source and cancelled responsive to slow changes of light in said monitored light source.

8. A photometric monitoring system in accordance with claim 1 further including trigger generator means coupled to said amplifier means for producing a trigger when said electrical signal exceeds a predetermined threshold, said utilization means being responsive to said triggering signal.

9. A photometric monitoring system in accordance with claim 8 wherein said trigger generator means includes a threshold network to provide a triggering window having a pair predetermined threshold levels so that said trigger generator means produces a triggering signal responsive to either positive-going or negative excursions of said electrical signal.

10. A photometric monitoring system in accordance with claim 9 wherein said threshold network includes peak detectors and storage means to change said threshold levels wherein an electrical signal peak of one polarity and insuffient amplitude to reach one of said threshold levels is stored for a predetermined time to establish a new threshold level such that an electrical signal of opposite polarity of sufficient amplitude to reach said new threshold level occuring within said predetermined time will cause a trigger signal to be produced.

11. A photometric monitoring system in accordance with claim 8 further including pulse generator means coupled to said trigger generator means for producing a pulse of predetermined amplitude and selectable length, said utilization means being responsive to said pulse.

* * * * *

UNITED STATES PATENT OFFICE

CERTIFICATE OF CORRECTION

Patent No. 4,032,777 Dated June 28, 1977

Inventor(s) Robert Earl McCaleb

It is certified that error appears in the above-identified patent and that said Letters Patent are hereby corrected as shown below:

In the title, "PHOTOMERIC" should be --PHOTOMETRIC--.

In column 1, line 9, after 'photometric" insert --monitoring--.

In column 2, line 4, "mountng" should be --mounting--.

In column 2, line 43, "or" should be --of--.

In column 2, line 45, "or" should be --for--.

In column 3, line 23, cancel "by."

In column 3, line 34, "is" should be --at--.

In column 5, line 58, "circuit," first occurrence, should be --circuitry--.

In column 6, line 44, "nagative" should be --negative--.

In column 7, line 12, "increase," second occurrence, should be --increases--.

In column 7, line 27, "may," second occurrence, should be --made--.

In column 8, line 9, after "one" insert --end--.

In column 8, line 15, after "light" insert --source--.

In column 8, line 22, "referennce" should be --reference--.

In column 8, line 25, "each" should be --said--.

In column 8, line 41, after "pair" insert --of--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*